US005136816A

United States Patent [19]

Beckingham

[11] Patent Number: 5,136,816

[45] Date of Patent: Aug. 11, 1992

[54] EDGE SHARPENER FOR SKIS

[76] Inventor: William J. Beckingham, Maisonettes, Smarden Road, Headcorn, Kent, England, TN27 9SY

[21] Appl. No.: 602,278

[22] PCT Filed: May 12, 1989

[86] PCT No.: PCT/GB89/00516

§ 371 Date: Jan. 11, 1991

§ 102(e) Date: Jan. 11, 1991

[87] PCT Pub. No.: WO89/10778

PCT Pub. Date: Nov. 16, 1989

[30] Foreign Application Priority Data

May 13, 1988 [GB] United Kingdom ..... 8811370

[51] Int. Cl.[5] ..... A63C 11/06

[52] U.S. Cl. ..... 51/128; 51/109 BS; 51/134.5 R; 51/352; 51/354; 76/83; 76/88

[58] Field of Search ..... 51/116, 128, 362, 109 R, 51/109 BS, 110, 125, 134.5 R, 210, 352, 354, 54; 76/83, 88

[56] References Cited

U.S. PATENT DOCUMENTS

| | | | |
|---|---|---|---|
| 3,512,308 | 1/1967 | Scheu, Jr. . | |
| 4,180,946 | 1/1980 | Heijkenskjold et al. | 51/134.5 R |
| 4,333,273 | 6/1982 | Roucau et al. | 51/128 X |
| 4,603,509 | 8/1986 | Kunieda et al. | 51/362 X |
| 4,630,409 | 12/1986 | Hofstetter | 51/392 X |
| 5,027,280 | 6/1991 | Ando et al. | 51/134.5 R X |

FOREIGN PATENT DOCUMENTS

| | | |
|---|---|---|
| 2460188 | 6/1976 | Fed. Rep. of Germany . |
| 2758531 | 7/1979 | Fed. Rep. of Germany . |
| 8418881 | 6/1986 | Fed. Rep. of Germany . |
| 2537446 | 5/1983 | France . |
| 661876 | 8/1987 | Switzerland . |

*Primary Examiner*—Bruce M. Kisliuk
*Assistant Examiner*—John A. Marlott
*Attorney, Agent, or Firm*—Breiner & Breiner

[57] ABSTRACT

According to the present invention there is provided an apparatus for sharpening an elongate edge, especially the blade edge of a ski. The apparatus comprises an abrasive disc set in a housing, a motor unit for rotating the disc about its axis, a guide surface parallel to the plane of the disc, guide means defining a guide plane substantially at right angles to the guide surface, and means to bias the disc axially to a position just proud of the guide surface.

7 Claims, 3 Drawing Sheets

EDGE SHARPENER FOR SKIS

This invention relates to apparatus for sharpening edges, particularly to such apparatus adapted for sharpening the edges of skis. It can, however, be used for sharpening other edges if desired.

The base of a modern ski has two metal edges on its lower surface. In order for the skier to be able to turn satisfactorily, especially on ice surfaces, it is necessary that these edges are sharp. This is conventionally done by skilled personnel carrying out ski sharpening services in association with the sale of skis and ancillary ski-ing equipment.

The ski-owner can sharpen his own skis if he has a suitable tool for doing so. A known tool consists of a short metal file set in an L-section holder provided with a handle. The user moves the holder along the ski edge with the file at the side of the ski. This known implement is not very easy to use to give good results.

Other types of hand-held or hand operated ski sharpening tools are known but these also do not produce satisfactory results.

Electrically operated ski sharpeners are known in which a grinding wheel is driven by an electric motor, the grinding wheel being mounted on the output shaft of the motor. In French Patent Specification 2516004, the ski sharpener disclosed is operated by moving the rotating grinding wheel along the edge of the ski, means being provided to guide the wheel as it is moved along the edge. In this sharpener, it is not possible to adjust the amount of material removed as the device is moved along the edge. If a large amount of material is to be removed, the device has to be used several times to achieve that result.

European Patent Specification 0058983 discloses another ski sharpening device. In this device, the motor is pivotally mounted about an axis transverse to the motor axis which allows the motor limited angular movement about that axis. A compression spring is used to bias the motor within a housing to a position where the motor axis forms a small angle to the motor axis position when the device is operating. This small angle is typically 2° to 3°. The biasing force of the spring is overcome by the reaction between the edge of the ski and the grinding wheel so that the motor can only be operated when the motor axis is correctly aligned. The sharpening device is held against the edge of the ski and guide means are provided to assist movement of the device along the edge. The amount of material removed from the edge can be varied by altering the biasing force exerted by the spring on the motor.

In the electrically operated ski sharpening devices described above, the circumferential surface of the grinding wheel is used to sharpen the edges, and because the whole grinding surface of the wheel tends not to be used and hence is worn away unevenly, the grinding surface has to be dressed frequently in order to optimise the grinding performance of the wheel to produce satisfactory results.

According to the present invention there is provided apparatus for sharpening an elongate edge, especially the blade at the edge of a ski, comprising an abrasive disc set in a housing, a motor unit for rotating the disc about its axis, a guide surface parallel to the plane of the disc, guide means defining a guide plane substantially at right angles to the guide surface, and means to bias the disc axially to a position just proud of the guide surface.

Advantageously, the motor unit includes an axially adjustable spindle on which the disc is mounted. The position of the spindle may be adjusted within the motor unit by means of a set screw and lock nut arrangement. The means for biasing the disc may comprise a compression spring mounted in the housing which acts on the disc to move it away from the guide surface.

Alternatively, the motor armature carried by the spindle can be axially movable and urged by magnetic forces between the armature and motor housing to cause the abrasive disc to be moved away from the guide surface.

Preferably, the guide means comprises a pair of rollers, one positioned on each side of the motor unit, the surfaces of the rollers defining a guide plane which is tangential to the rollers.

Each roller may be attached at one end to the guide surface and be free at its other end.

It is possible to use the sharpener of the invention to sharpen the edge so that it has an included angle of just less than 90°. This can be achieved by tilting the ski with respect to the sharpener. In one embodiment, adjustment can be provided by a set of O-rings which are positioned in grooves on the rollers. The angle of deviation from 90° can be determined by the position of the O-rings relative to the guide surface, for example, the further away the O-rings are from that surface the smaller the angular deviation from 90°. Alternatively, an adjustable strap can be used to guide the ski relative to the guide surface.

It is preferred that the disc has an abrasive diamond surface, but any other abrasive material can be used.

For a better understanding of the invention, reference will now be made by way of example only to the accompanying drawings, in which.

Figure 1:
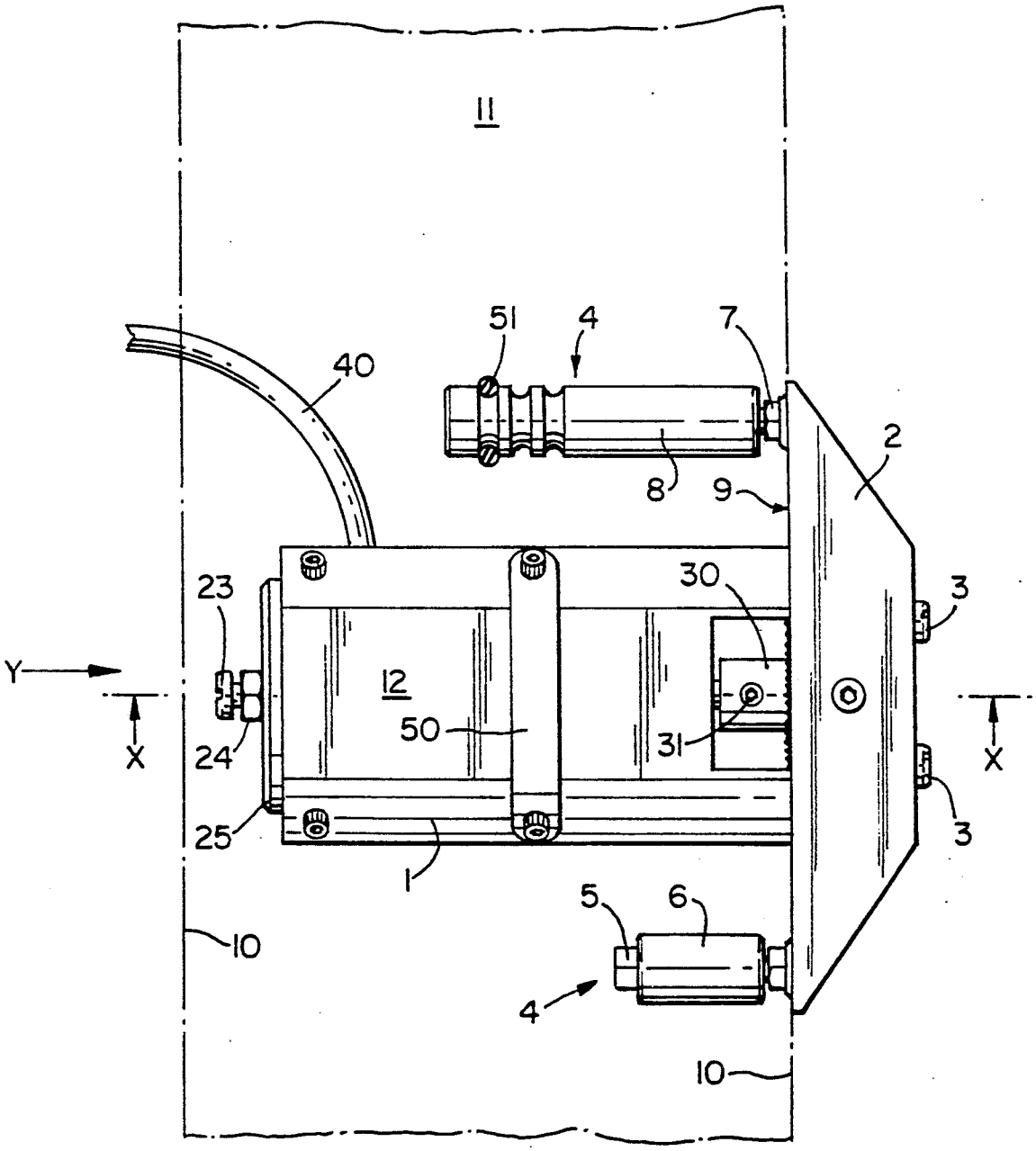
FIG. 1 is a view of a ski-sharpener unit seen from below.
Figure 2:
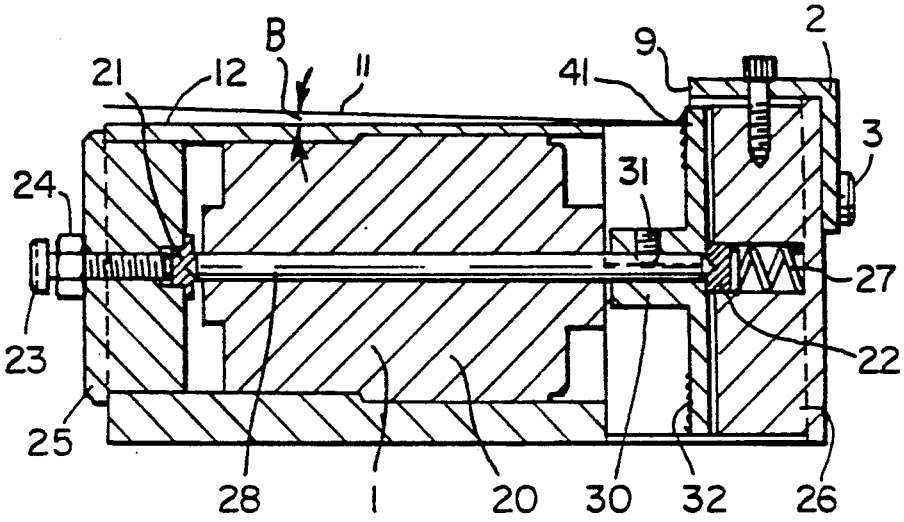
FIG. 2 is a sectional view along the lines X—X on FIG. 1.
Figure 3:
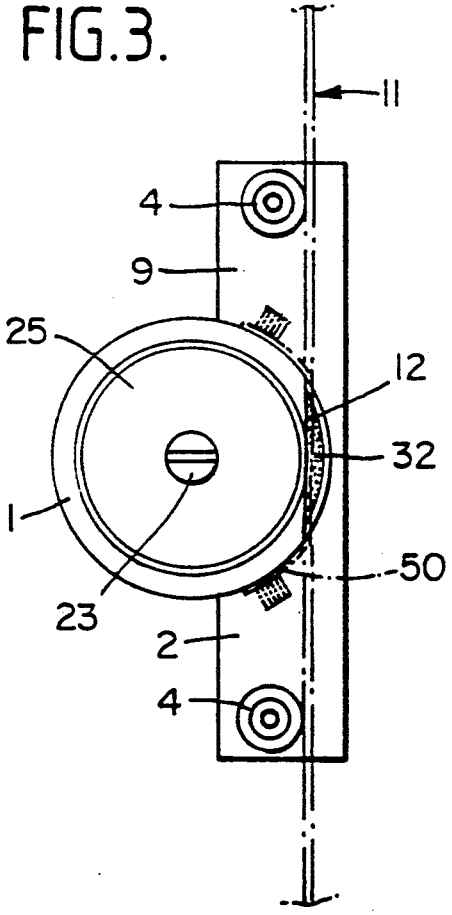
FIG. 3 is an end view seen in the direction of Arrow Y on FIG. 1.

Referring to the FIGS. 1 to 3, the unit has a generally cylindrical housing 1 having a transverse endpiece 2 fixed to one end by a pair of bolts 3.

Attached to endpiece 2 at either side of housing 1 is a roller 4 extending parallel to housing 1. Two different sorts of roller are illustrated in FIG. 1, but in practice the rollers would match, being either a stud 5 bearing a free-running roller sleeve 6, or a longer stud 7 bearing a free-running roller sleeve 8 of somewhat different configuration from sleeve 6.

The surfaces of the two rollers 4 define a guide plane tangent to the rollers and which is at right angles to a guide surface 9 of endpiece 2. A ski or other elongate blade to be sharpened can thus be located relative to the unit by resting it on rollers 4 and aligning its edge against the guide surface 9. The edges 10 of the ski would lie where shown by dashdot lines in FIG. 1. In practice, the unit would be laid on the upturned ski, rather than laying the ski on the unit.

The exterior of cylindrical housing 1 is cut away to give a flat face 12 as shown.

Inside housing 1 is a motor unit 20 (as shown in FIG. 2). The armature of the motor carried by spindle 28 can move axially in bearings, and its precise position is controlled by end bushes 21, 22. The position of end bush 21 is set by a set screw 23 and lock nut 24, screw 23 being threaded in one end cap 25 of housing 1.

Bush 22 is set in an opposite end cap 26 and is biased toward the motor by a compression spring 27. Bush 22 presses not directly on the spindle of the motor but on one face of an abrasive disc 30 set on the spindle and secured by a grub screw 31.

Disc 30 has an abrasive surface 32, preferably formed by attaching diamond abrasive to the disc face, though other abrasive materials can be used if desired. Diamonds, e.g. diamond chippings of grit size 120 to 220, are preferred, with a grit size of 160 being a suitable compromise between too coarse (which would not sharpen as well and which would remove an excessive amount of the blade at the ski edge) and too fine (which would sharpen very well, but take a long time).

Power for the motor is fed in by an electrical lead 40. When the motor is activated disc 30 turns and the edge of the ski located at 41 is abraded by abrasive surface 32. The pressure which the disc 30 exerts on the edge is controlled by spring 27, so the user cannot overgrind the ski edge. As the unit is placed on the ski to sharpen the edge, and the edge of the ski brought to lie against guide surface 9, the whole motor armature and spindle 28 moves slightly to the right as shown in FIG. 1, bringing the abrasive surface 32 of disc 30 from a position just proud of surface 9 to being flush with it. When so placed on the ski, the motor is actuated and the unit slid along the ski until the desired sharpening has been achieved.

Instead of using the spring 27 to bias the disc against the edge to be sharpened, magnetic forces in the motor itself can be employed.

For each motor, there is an axial position of the armature within the motor housing to which the magnetic forces urge the armature. If the armature is moved from that axial position relative to the housing, there is a net magnetic force tending to move the armature back to that position. This net magnetic force can be used to provide the biasing of the armature so that the disc 30 can exert a controlled cutting force or cutting pressure on the edge of the ski.

Figure 4:
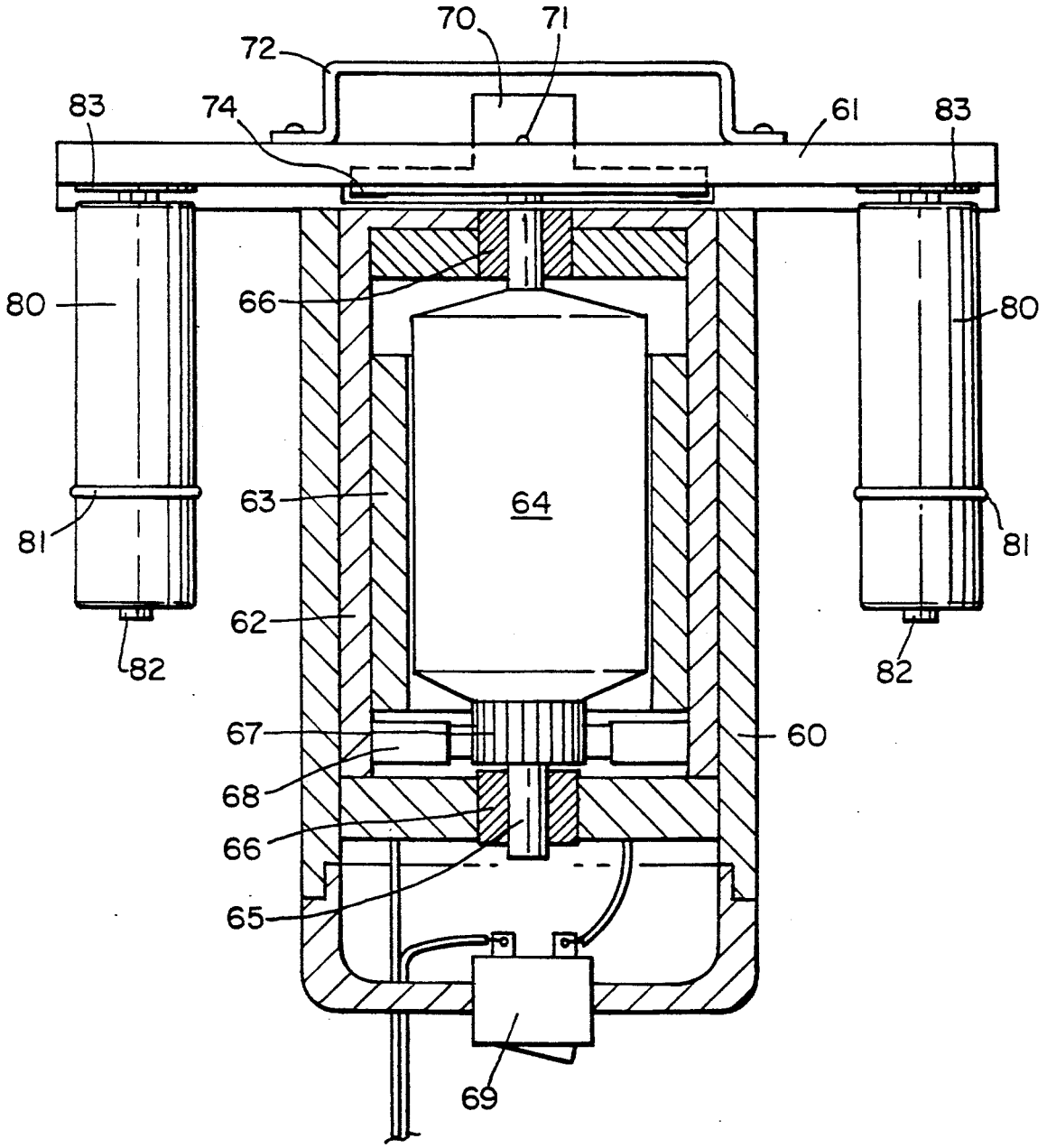
FIG. 4 is a part sectional view of a further embodiment of the invention.

The force of gravity can be used in combination with this magnetic effect to vary the amount of cutting pressure applied to the edge of the ski. FIG. 4 illustrates how this can be effected.

FIG. 4 shows partly in section an alternative form of ski edge sharpener according to the invention.

Referring to this Figure, a motor is located in a casing 60 which is attached to a guide plate 61. Set in casing 60 is an electric motor consisting of an outer motor casing 62, fixed permanent field magnets 63, and an armature 64 rotating on a spindle 65. Spindle 65 rotates in sintered metal bearings 66 and projects into an aperture in guide 61. Mounted on the projecting end of spindle 65 is a disc 70 fixed in position by a set screw 71. A protective cover 72 prevents access to the disc when in place. At either end of the guide member 61 are freely rotatable rollers 80, each of which has an O-ring 81 resiliently thereon. Rollers 80 are mounted on spindles 82 at the base of which, where the spindle is fixed to guide member 61, there is a thin steel shim 83 on guide member 61.

Shims 83 constitute the actual bearing surface against which the edge of the ski to be sharpened is placed when the sharpener is to be used.

The general arrangement of the abrasive disc 70 and guide rollers 80 corresponds to the corresponding general arrangement as shown in FIGS. 1 to 3 with respect to rollers 4 and disc 30.

Internally of the motor, the spindle carries at the end of armature 64 a commutator 67 cooperating with brushes 68 to which electrical power is fed in standard fashion. The end of the casing includes a switch 69.

The spindle 65 has a degree of axial float in the bearings 66. As can be seen from the drawing, permanent field magnets 63 are offset from armature 64 and thus accordingly bias the armature downwards as seen in FIG. 4.

The abrasive faced disc 70 is positioned with the aid of set screw 71 on the end of shaft 65 such that its outer annulus of abrasive material, denoted 74 in FIG. 4, is in a plane a short distance downwardly as seen in FIG. 4 from the plane defined by the surfaces of shims 83. This short distance corresponds to the maximum depth of cut achievable in a straight edged blade abutted against shims 83.

Because of the axial free movement possible for the assembly of armature 64, commutator 67 and shaft 65, when an edge is placed for sharpening against shims 83, the working surface 74 lies coplanar with the surfaces of shims 83.

The working surface of the disc is, however, biased towards the bottom of the drawing shown in FIG. 4 and the amount of bias will determine the rate at which, for a given rotational speed, the surface, e.g. of a ski edge held against shims 83 will be ground down.

It can be seen that the pressure of the abrasive face 74 of the disc 70 against an edge to be sharpened which is laid abutting shims 83 will be made up of two components, that is to say a force arising from the magnetic interaction between field magnets 63 and armature 64, and the force of gravity acting on the assembly of armature, commutator, spindle and disc.

Thus, if the device of FIG. 4 is used with the axis of spindle 65 horizontal, the bias with which the abrasive surface is pressed against the edge to be sharpened will consist solely of the magnetic force components. It may be increased by turning the assembly of ski to be sharpened and sharpener so that the disc 70 is above the ski edge, with the axis of spindle 65 vertical. This is the maximum force obtainable and will give the greatest amount of grinding over a given time. If, on the other hand, all that is required is for the edge to be given a final light sharpening polishing action, then the device may be used again with its motor shaft 65 vertical but with the abrasive disc 70 below the blade edge to be sharpened. Obviously for this the magnetic forces must be capable of just slightly overcoming the gravitational forces. Clearly, by rotating the assembly, the pressure exerted by the abrasive face 74 on the edge may be varied continuously.

It is sometimes desired to sharpen the blade to have an included angle of just less than 90°. This may be achieved with the unit of the invention by tilting the ski slightly with respect to the unit, e.g. by an angle "B" as shown on FIG. 2. This may be achieved in controlled fashion by the use of an adjustable strap 50 set across surface 12 and which can be set to engage the bottom of the ski. Alternatively, rollers 8 may have O-rings set in grooves in their circumferences. A set of axially spaced grooves on each roller 8 allows for fine adjustment. One O-ring is shown at 51 for illustration. The further the O-rings are from the surface 9, the smaller the angle "B". In FIG. 4, O-rings 81 are set on rollers 80 for the same purpose.

The motor may be any convenient voltage. Particularly preferred is a 12 V winding which may be provided with power from a vehicle battery (e.g. via a plug inserted into the cigar lighter socket) or from a mains step-down transformer unit. A typical motor power is 100 watts.

I claim:

1. Apparatus for sharpening an elongate edge, especially the blade at the edge of a ski, comprising an abrasive disc set in a housing, an electric motor for rotating the disc about its axis, a guide surface parallel to the plane of the disc, and guide means defining a guide plane substantially at right angles to the guide surface, wherein the motor includes an axially-movable spindle to which the disc is fastened, and a permanent field magnet positioned so as to apply force on the spindle to bias the disc towards the motor at all times.

2. Apparatus according to claim 1 wherein the spindle movement towards the motor is determined by means of a set screw and lock nut.

3. Apparatus according to claim 1 wherein the guide means comprises a pair of rollers and the surfaces of the rollers define a guide plane which is tangential to the rollers.

4. Apparatus according to claim 3 wherein each roller is attached at one end to the guide surface and is free at its other end.

5. Apparatus according to claim 3 or 4 wherein each roller has a plurality of axially spaced grooves formed in its circumference for retaining an O-ring.

6. Apparatus according to claim 1 further comprising a removable strap on the motor housing intended to engage a surface of the ski in such a manner as to tilt the ski edge so that the ski edge meets the plane of the disc at an included angle of just less than 90°.

7. Apparatus according to claim 1 wherein the disc has an abrasive diamond surface.

* * * * *